US007037132B2

(12) United States Patent
Nagano et al.

(10) Patent No.: US 7,037,132 B2
(45) Date of Patent: May 2, 2006

(54) SOCKET DEVICE

(75) Inventors: Masamitsu Nagano, Imabari (JP); Kazuo Tomita, Imabari (JP); Toshiyuki Arai, Yokohama (JP)

(73) Assignee: Harison Toshiba Lighting Corp., Ehime (JP)

( * ) Notice: Subject to any disclaimer, the term of this patent is extended or adjusted under 35 U.S.C. 154(b) by 0 days.

(21) Appl. No.: 11/065,297

(22) Filed: Feb. 25, 2005

(65) Prior Publication Data

US 2005/0196997 A1 Sep. 8, 2005

Related U.S. Application Data

(63) Continuation-in-part of application No. 10/887,315, filed on Jul. 9, 2004.

(30) Foreign Application Priority Data

Jul. 14, 2003 (JP) ..... 2003-196418
Feb. 27, 2004 (JP) ..... 2004-053807

(51) Int. Cl.
*H01R 13/73* (2006.01)

(52) U.S. Cl. ..... 439/547

(58) Field of Classification Search ..... 439/456–459, 439/547, 619, 699.2
See application file for complete search history.

(56) References Cited

U.S. PATENT DOCUMENTS 3,864,001 A * 2/1975 Millet ..... 439/547
4,593,958 A * 6/1986 Baba ..... 439/77
4,957,455 A * 9/1990 Horiuchi et al. ..... 439/548
5,513,082 A * 4/1996 Asano ..... 362/656
6,155,874 A * 12/2000 Endo et al. ..... 439/547
6,217,340 B1 * 4/2001 Gordon ..... 439/57
6,551,133 B1 * 4/2003 Tsukamoto et al. ..... 439/549

* cited by examiner

*Primary Examiner*—Gary F. Paumen
(74) *Attorney, Agent, or Firm*—Banner & Witcoff, Ltd.

(57) ABSTRACT

A socket device according to an embodiment of the present invention includes a tubular main body 1 made of an electrically insulating material. The tubular main body 1 provides a lamp-loading hole 12 having an opening at upper end, through which a baseless lamp 6 is inserted. A notch 3 is formed in a wall of the tubular main body 1, which extends downward from the opening of the lamp-loading hole 12 along an axis of the tubular main body 1. A flange portion 2 is provided around the tubular main body 1 at a portion spaced from the lower end of the notch 3. First and second protrusions 41, 42 are provided on both sides of the notch portion 3 on the outer surface of the tubular main body 1. An electrically conducting connecting member 5*c* having a terminal piece 153 is provided so that the base portion 151 of the terminal piece 153 is inserted in the lamp-loading hole and a leading portion of the terminal piece 153 passes through the notch portion 3 extending to a position between the first and the second protrusions 41, 42.

18 Claims, 10 Drawing Sheets

(a)

(b)

SOCKET DEVICE

This application is a continuation in part of U.S. patent application Ser. No. 10/887,315 filed Jul. 9, 2004, entitled, "A Socket Device," which claims the benefit of priority to Japanese Patent Application No. 2003-196418, filed Jul. 14, 2003. This application claims the benefit of priority to Japanese Patent Application No. 2004-053807 filed Feb. 27, 2004, the contents the noted applications are herein incorporated by reference in their entirety.

FIELD OF THE INVENTION

The present invention relates to a socket device for loading baseless lamps such as small size incandescent lamps or light emitting diodes.

BACKGROUND OF THE INVENTION

Socket devices for baseless lamps such as incandescent lamps and light emitting diodes are widely used in audio and video instruments, meters for cars, liquid crystal displays, or displays for a controller used in plants. Those socket devices have such merits that supporting and electrical connections of the lamps can be easily made with a simple structure and a low cost when they are assembled on printed circuit boards.

The conventional socket device for baseless lamps is provided with a tubular main body, which is a bottomed cylinder made of electrically insulating material such as resin or rubber. The tubular main body has a lamp-loading hole having an opening at upper end, through which a baseless lamp is inserted. In the outer wall forming the lamp-loading hole, a pair of notches is formed, which extend downward along the tubular socket axis from the leading end of the hole. The pair of notches is arranged on the diametrically opposing positions of the lamp-loading hole. On the outer surface of the tubular main body, flange portion is also provided around the tubular main body at a prescribed distance from the lower ends of the pair of notches. A protrusion is also provided at a prescribed distance from the flange portion on the outer surface of the tubular main body. The protrusion is arranged at a position spaced from the notches in the circumferential direction of the outer surface of the tubular main body. Electrically conducting connecting members made of a metal plate are provided in the loading hole. Sealing portions of a wedge base type lamp is connected and is supported on the connecting members. A pair of terminal pieces is connected with the connecting member. These terminal pieces pass through the pair of notches and extrude on the outer side of the tubular main body.

The socket device is assembled after inserting the tubular main body having the protrusion into a socket assembly hole formed on a printed circuit board, by turning the main body with the printed circuit board sandwiched between the protrusion and the flange portion. At this time, the terminal piece is in contact with a wire conductor made of such a thin film as a copper foil formed on the surface of the printed circuit board, through which electricity is supplied to turn on the lamp.

Here, in one type of the socket device known to the public, the terminal piece is arranged to protrude at a position spaced from the flange portion, and to contact with wire conductors formed on an upper surface of the printed circuit board.

In the other type of the socket device also known to the public, the terminal piece is received in a concave portion formed in the flange portion, in order to contact with the wire conductors formed on an under surface of the printed circuit board.

In yet other type of the socket device known to the public, the above-mentioned two types are combined, in which a pair of terminal pieces is provided, which is contact with the both sides of the board, when the socket device is loaded on the printed circuit board.

In the conventional socket devices described, the terminal pieces are protruding from the outer surface of the main body of the socket device. Therefore, when a lot of the socket devices are put together into a container boxes while manufacturing, assembling or carrying, the terminal pieces protruding from the socket body contact with other socket devices or a wall of the container box, and sometimes they are deformed. If such deformation takes place in the terminal piece, insufficient contact between the terminal piece and the wire conductor of the printed circuit board occurs, and, in the worst case, it is impossible to assemble the socket device on the printed circuit board.

It is an object of the present invention to solve the above-mentioned problems, and to provide a socket device, in which the deformation of the terminal pieces extruding from the outer surface of the main body of the socket device is prevented and an electric connection is secured.

SUMMARY OF THE INVENTION

The socket device according to an embodiment of the present invention includes a tubular main body made of an electrically insulating material. The tubular main body provides a lamp-loading hole having an opening at an upper end, through which a baseless lamp is inserted. A notch portion is formed in a wall of the tubular main body, which extends from the opening of the lamp-loading hole along an axis of the tubular main body. A flange portion is provided around the tubular main body at a portion spaced from the lower end of the notch. First and second protrusions are provided on both sides of the notch portion on the outer surface of the tubular main body. An electrically conducting connecting member having a terminal piece is provided so that the base portion of the terminal piece is inserted in the lamp-loading hole and a leading portion of the terminal piece passes through the notch portion extending to a position between the first and the second protrusions.

In the socket device according to the embodiment of the present invention, the leading portion of the terminal piece is provided at a position spaced from the flange portion.

In the socket device according to the embodiment of the present invention, the terminal piece is made in contact with the wire conductor formed on the surface of the printed circuit board, when the socket device is loaded on a printed circuit board.

Further, in the socket device according to the embodiment of the present invention, the socket device is inserted in the loading hole formed on the printed circuit board and is assembled by turning the main body in the loading hole with the printed circuit board sandwiched between the flange portion and the first and the second notches. In this way the socket device is loaded on the printed circuit board.

Further, in the socket device according to the embodiment of the present invention, the first protrusion is provided, having a stopper portion which is extended to the flange portion or to its vicinity, so as to stop further turning of the socket device on the printed circuit board, when the socket device is loaded on the loading hole of the printed circuit board.

Further, in the socket device according to the embodiment of the present invention, the second protrusion has an under surface facing with the flange portion, which is inclined so as to make it easy for the printed circuit board to be inserted into the gap between the under surface of the second protrusion and the flange portion, when the socket device is loaded in the loading hole of the printed circuit board.

Further, in the socket device according to the embodiment of the present invention, the baseless lamp is supported by and connected with the base portion of the connecting member loaded in the lamp-loading hole of the tubular main body.

The socket device according to the embodiment of the present invention, the deformation of the terminal pieces can be prevented when it is put together with other socket devices into the container box while it is manufactured, assembled or carried, because the leading portion of the electrically conducting terminal pieces protruding from the tubular main body are provided at a position protected by the first and second protrusions as well as by a flange portion from being in contact with other socket devices or the inner wall of the container box.

BRIEF DESCRIPTION OF THE DRAWINGS

The foregoing summary of the invention, as well as the following detailed description of illustrative embodiments, is better understood when read in conjunction with the accompanying drawings, which are included by way of example, and not by way of limitation with regard to the claimed invention.

DETAILED DESCRIPTION OF ILLUSTRATIVE EMBODIMENTS

In the following description of various illustrative embodiments, reference is made to the accompanying drawings, which form a part hereof, and in which is shown, by way of illustration, various embodiments in which the invention may be practiced. It is to be understood that other embodiments may be utilized and structural and functional modifications may be made without departing from the scope of the present invention.

Figure 1:
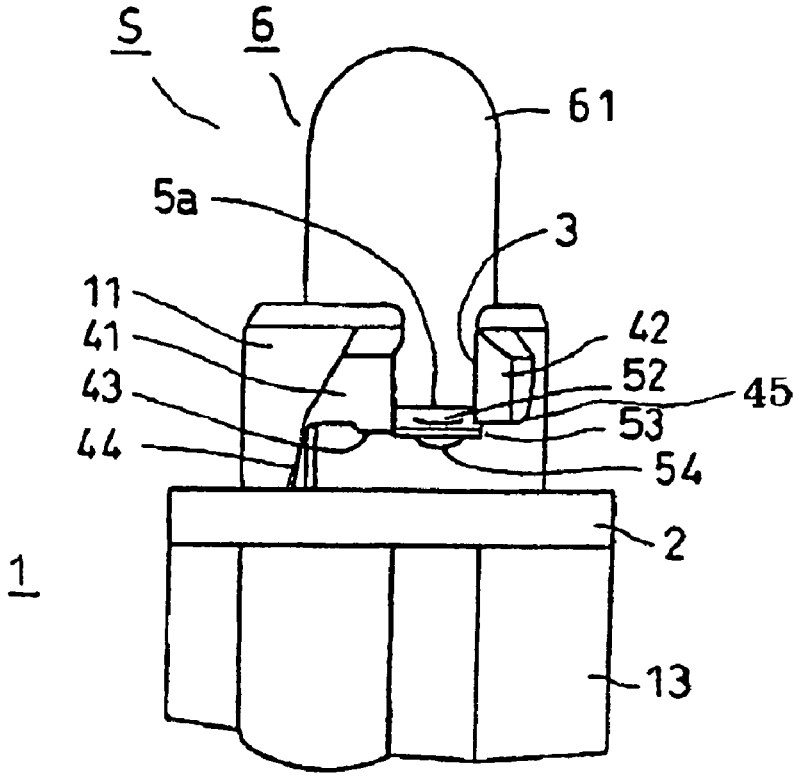
FIG. 1 is a front view showing a first embodiment of the socket device according to the present invention.
Figure 2:
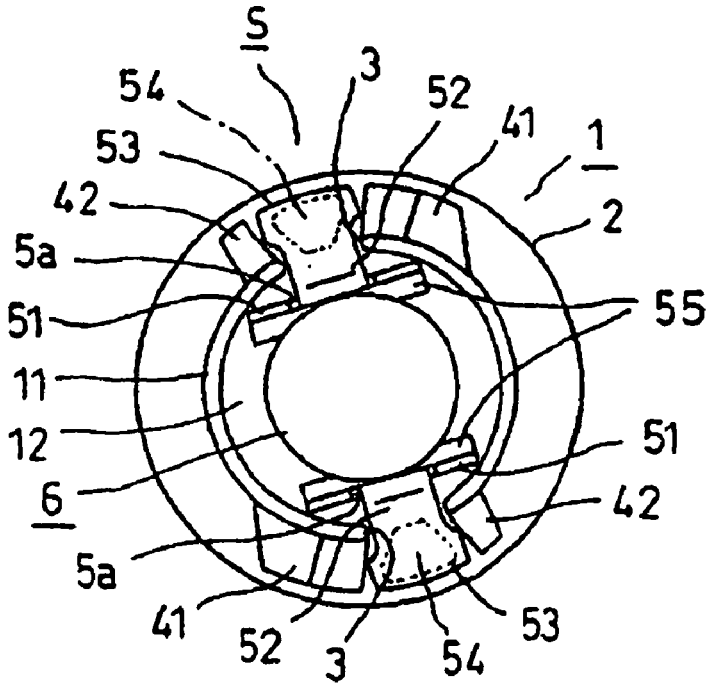
FIG. 2 is a top view showing the socket device shown in FIG. 1 without a baseless small lamp 6 shown.
Figure 3:
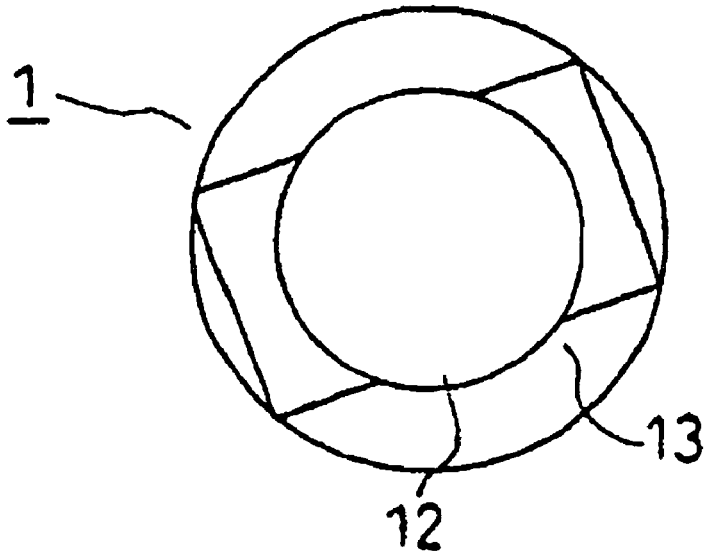
FIG. 3 is a bottom view showing the socket device shown in FIG. 1.
Figure 4:
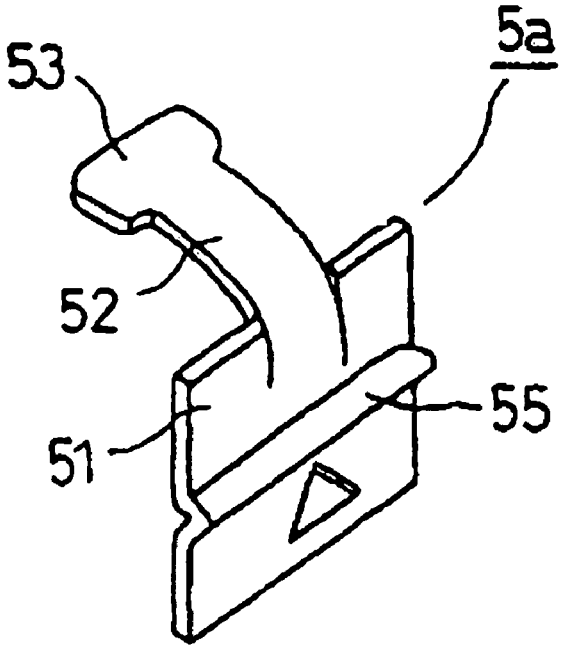
FIG. 4 is a perspective view showing a connecting member of the socket device shown in FIG. 1.

An embodiment of the socket device according to the present invention will be explained below referring to FIG. 1 to FIG. 4. FIG. 1 is a front view of the socket device S. FIG. 2 is an upper view of the socket device S. FIG. 3 is a bottom view of the socket device S. FIG. 4 is a perspective view of a connecting member used in the socket device S.

In the figures, a tubular main body 1 includes a bottomed cylinder having a cylindrical cross section made of an electrically insulating material. As the electrical insulating material, thermoplastic resin such as, for example, 66 Nylon (a trade name) is used. The tubular main body 1 provides a lamp-loading hole 12 having an opening at its upper end, from which a baseless small lamp is inserted, as described below. On the outer surface of a wall 11 of the tubular main body 1, a pair of notches 3, 3 are formed extending downward from the opening of the lamp-loading hole 12 along an axis of the tubular main body 1. The notches 3, 3 are provided on the diametrically opposite positions of the lamp-loading hole 12. A flange portion 2 is provided around the tubular main body 1 at a portion spaced from the lower end of the notches 3, 3. First and second protrusions 41 and 42 are provided on both sides of each of the notches 3, 3 on the outer surface of the tubular main body 1. The first protrusion 41 has a stopper portion 44, which is extended to an upper surface of the flange portion 2 or to its vicinity. A convex portion 43 is formed on the lower surface of the first protrusion 41. A space between an under surface of the concave portion 43 and the upper surface of the flange portion 2 is selected to be equal to or a little bit smaller than a thickness of a printed circuit board, as will be described later. On the other hand, the second protrusion 42 has an under surface 45 facing with the flange portion 2 and being inclined with respect to the upper surface of the flange portion 2.

A base portion 51 forming a connecting member 5*a* is loaded in the lamp-loading hole 12, as shown in FIG. 4. A coupling convex 55 is formed on a substantially planer base portion 51, which fits in a concave portion (not illustrated) formed on an inner wall of the lamp-loading hole 12 and is fixed there. The connecting member 5*a*, made of electrically conducting material, has a terminal piece 53 connected with the base portion 51. The terminal piece 53 passes through the notches 3, 3. A leading portion of the terminal piece 53 is extended to a portion between the first and second protrusions 41 and 42. The terminal piece 53 is bent outward at its central portion 52 to provide a downward elastic force to the leading end. A convex contacting portion 54 is formed on the lower surface of the leading end of the terminal piece 53. The leading end of the terminal piece 53 is located at a position facing the upper surface of the flange 2 with a prescribed spacing.

Figure 5:
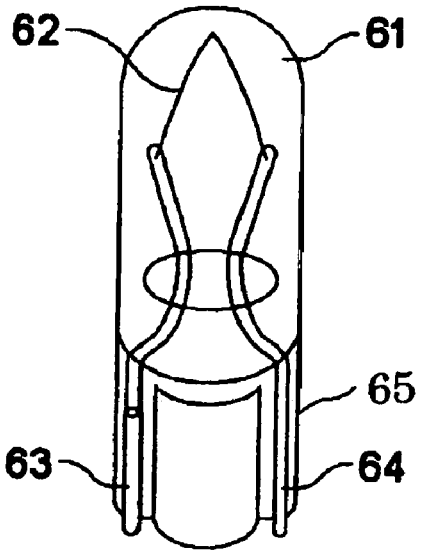
FIG. 5 is a front view of a baseless incandescent lamp to be loaded on the socket device shown in FIG. 1.

Next, a baseless small lamp 6 of wedge base type has a glass bulb 61 forming an envelope as shown in FIG. 5. A coiled filament 62 is enclosed in the glass bulb 61. Outer leads 63, 64 connected with the filament 62 are led to a lower sealed portion 65 of the glass bulb 61. End portions of the outer leads 63, 64 are led out of the lower sealed portion 65. The end portions of the outer leads 63, 64 are folded back along a front surface and a rear surface of the sealing portion 65 respectively. When the baseless small lamp 6 is inserted into the lamp-loading hole 12, the end portions being folded back of the outer leads 63, 64 contact with a flat base portion 51 of a pair of connecting members 5*a*, 5*a*, which are provided inside the lamp-loading hole 12.

The socket device according to the embodiment of the present invention, the deformation of the electrically conducting terminal pieces 53 can be prevented when it is put together with other socket devices into the container box while it is manufactured, assembled or carried, because the leading portion of the electrically conducting terminal pieces 53 protruding from the tubular main body 1 are provided at a position protected by the first and second protrusions 41, 42 as well as by a flange portion 2 from being in contact with other socket devices or the inner wall of the container box.

Figure 6:
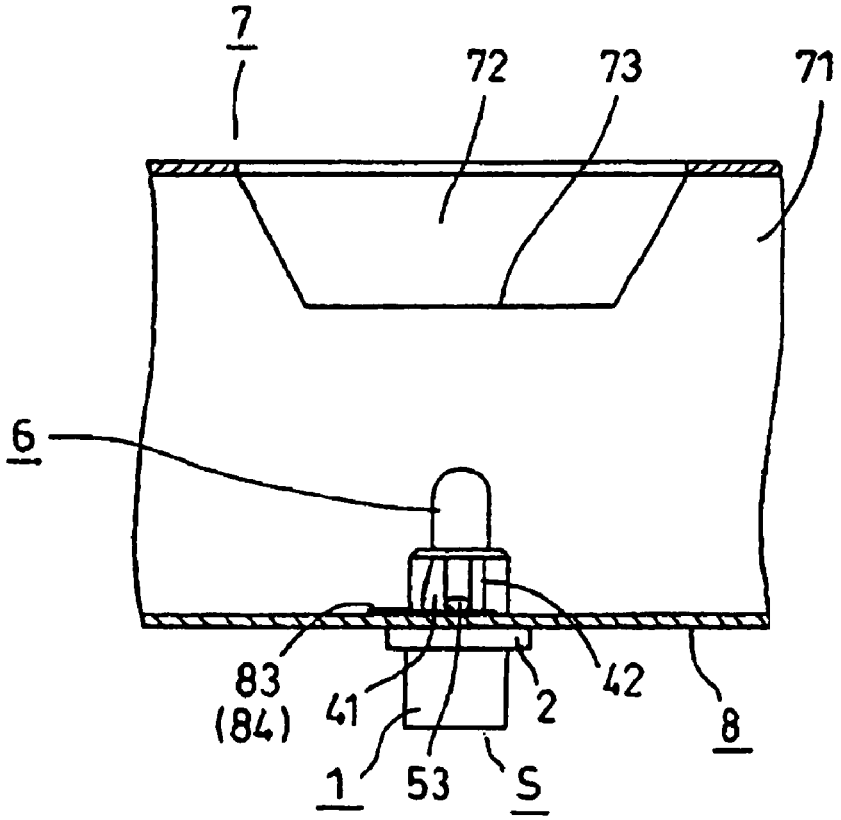
FIG. 6 is a side sectional view partly showing an example of display unit in which the socket device shown in FIG. 1 is used.
Figure 7:
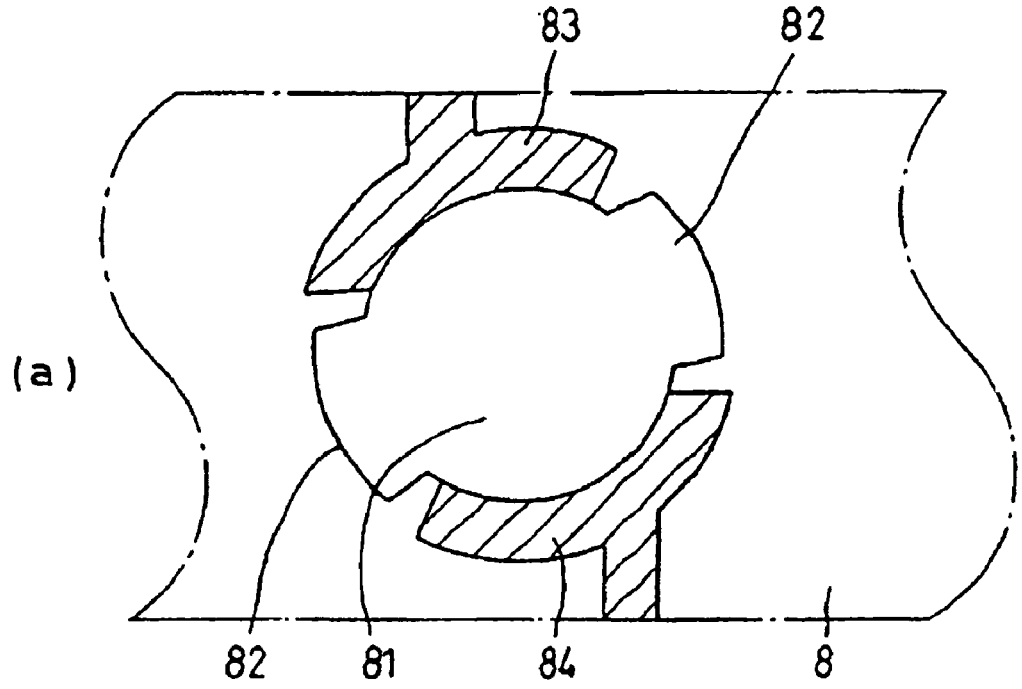
FIG. 7 shows the socket device shown in FIG. 1 loaded on a printed circuit board, wherein (a) is a plan view showing a part of the circuit board, (b) is a plan view showing a part of the printed circuit board in which the socket device is loaded.
Figure 7:
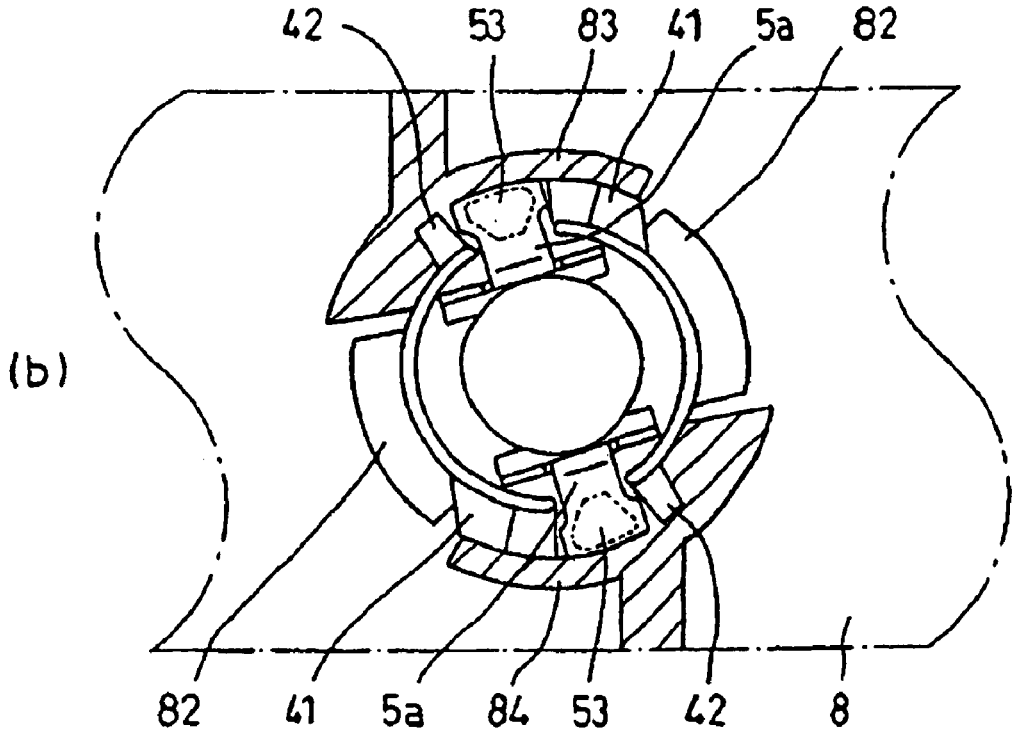

FIG. 6 is a side sectional view showing a part of a display unit 7 assembled in a meter for cars, in which the socket device S is mounted. FIG. 7 is a figure for explaining a method for mounting the socket device on a printed circuit board, wherein FIG. 7(*a*) is a plan view showing a part of printed circuit board on which a socket device is mounted, FIG. 7(*b*) is a plan view showing a part of printed circuit board on which socket device is mounted.

The display unit 7 is provided with a display plate 73 for displaying a warning message such as "DOOR OPEN", for example, on the concave portion 72 in front of a chassis 71. A socket device S is loaded in the socket loading hole 81 of the printed circuit board 8 arranged at a position facing the display plate 73, as shown in FIG. 7(*a*). On the printed circuit board 8 on which the socket device S is mounted, a socket loading hole 81 having nearly similar shape as the cross section of tubular main body 1 is provided. The loading hole 81 is nearly circular shape as a whole, and is provided with two recess portions 82, 82 at the opposite positions on the diameter of the loading hole 81. The recess portions 82, 82 are formed for passing the protrusions 41, 42 provided on tubular main body 1 when it is inserted into the loading hole 81. The length of the recess portions 82, 82 along the circumference of the loading hole 81 is so selected as the protrusion 41, 42 are allowed to pass through and to turn in the circumferential direction. On the surface of the printed circuit board 8, where the loading hole 81 is formed, wire conductors 83, 84 are printed in the vicinity of the loading hole 81. The wire conductors 83, 84 are formed on one side or on both sides of the printed circuit board 8.

Mounting of the socket device S on the printed circuit board 8 is carried out as follows. After adjusting the recess portions 82, 82 of the loading hole 81 of the printed circuit board 8 with the protrusion 41, 42, the socket device S is inserted into the loading hole 81 from a top portion of the bulb 61 of the small lamp 6 mounted in the socket device S. The socket device S is advanced until the flange portion 2 of the tubular main body 1 contacts with the printed circuit board 8. When the flange portion 2 is in contact with the printed circuit board 8, a grip portion 13 formed on the lower side of the tubular main body 1 is grasped and turned clockwise by hand. As a result, the printed circuit board 8 is sandwiched between the flange portion 2 and the protrusion 41, 42 and is fixed tight there. At this time, the terminal piece 53 contacts elastically with the surface of the flange portion 2. Then, the contacting portion 54 at the leading end of the terminal piece 53 is pressed to the wire conductor 83, 84 to make an electrical connection.

When turning the tubular main body 1 inserted in the loading hole 81, the convex portion 43. on the under surface of the first protrusions 41 and the inclined under surface 45 of the protrusion 42 slide smoothly on the surface of the wire conductors around the loading hole 81 of the printed circuit board 8. Here, the under surface 45 of the second protrusion 42 is made inclined with respect to the upper surface of the flange portion 2, a space between the under surface 45 and the upper surface of the flange portion 2 on one side, from which the printed circuit board 8 is inserted becomes larger than that on the other side. When the tubular main body 1 is turned by a prescribed angle, the stopper 44 provided on the first protrusion 41 contacts with the periphery of the recess portion 82, 82 formed on the printed circuit board 8, and stops further turn of the tubular main body 1, thereby completing the positioning the socket device S.

Next, dismounting of the socket device S from the printed circuit board 8 for replacement of baseless small lamp 6 or some other reasons is carried out by grasping the grip portion 13, turning it counterclockwise until the protrusions 41, 42 reach the recess portion 82, 82, and by withdrawing the socket device S from the socket loading hole 81.

With the socket device S as described, there is no fear of deformation of the terminal piece 53 when the socket device S is mounted in the loading hole 81 of the printed circuit board 8, because the terminal piece 53 led out from the tubular main body 1 is placed at a position enclosed by protrusion 41, 42 or by flange portion 2. Therefore, the mounting can be done easily and smoothly as well as a reliable electric connection can be secured.

Figure 8:
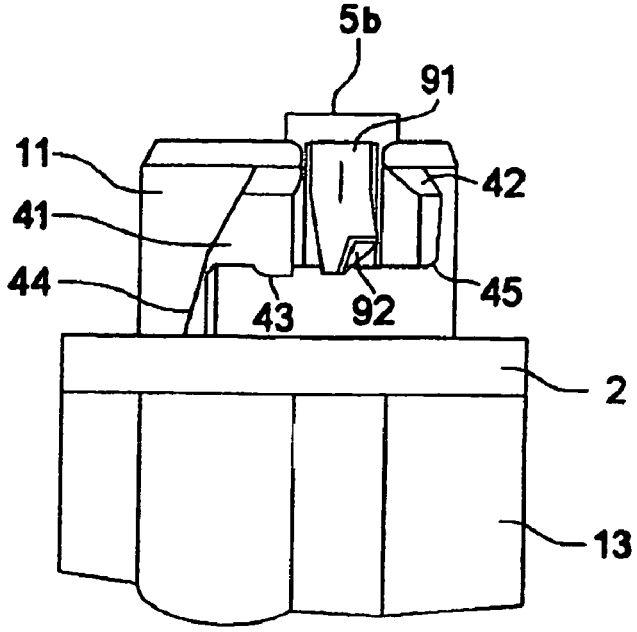
FIG. 8 is a front view showing a second embodiment of the socket device according to the present invention.
Figure 9:
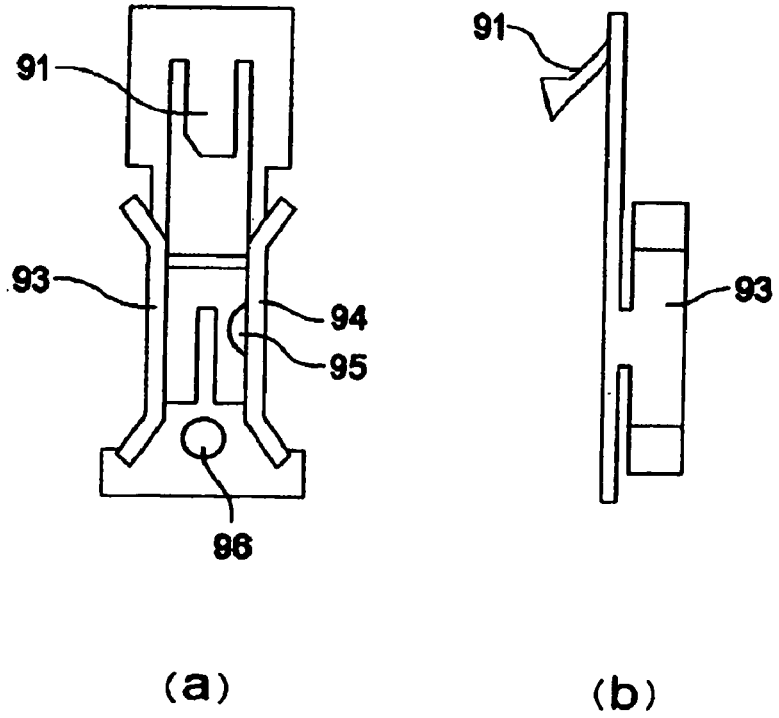
FIG. 9 shows a connecting member used for the socket device shown in FIG. 8, wherein (a) is a front view, (b) is a side view

FIG. 8 is a side view showing another embodiment of the socket device according to the present invention. In the present embodiment, the connecting member 5*a* in the embodiment described above is replaced by connecting members 5*b*, 5*b* having a different shape. FIG. 9 shows a rough sketch of the connecting member 5*b*, wherein (a) is a front view, (b) is a side view. The connection member 5*b* is provided with an electrically conducting terminal piece 91, which is connected with a base portion 90 made of metal plate. A corner portion of a leading end of the terminal piece is bent upward. On the base portion 90, a pair of pinching pieces 93, 94 which are arranged parallel and facing each other. On at least one of the pinching pieces 93, 94, a contacting protrusion 95 is formed. On the base portion 90, a coupling convex 96 is formed.

The connecting members 5*b*, 5*b* thus formed is inserted and fixed in the mounting groove (not illustrated) formed on the inner wall of the loading hole 12 of the tubular main body 1. At this time, the coupling convex 96 is received in a concave portion (not illustrated) formed on the inner wall of the loading hole 12 of the tubular main body 1. When the socket device S is inserted in the lamp-loading hole 12, both side portions of the lower sealing portion 65 of the baseless small lamp shown in FIG. 5 are inserted between the pinching pieces 93, 94 of the connecting members 5*b*, 5*b* and are supported by the pinching pieces 93, 94 with their elastic force. When the baseless small lamp 6 is inserted in the lamp-loading hole 12, end portions of the outer leads 63, 64 folded back on both side of the sealing portion 65, contact with the nearly planer base portion 51 of the connecting member 5*a*, which is loaded in the lamp-loading hole 12, and are electrically connected.

Next, method for loading or unloading the socket device S, into which a baseless small lamp 6 is inserted, in or from the lamp-loading hole 12 of the printed circuit board 8 is performed similarly as stated above in the first embodiment, thereby omitting a detailed explanation. Here, in the present embodiment, not only the under surface 45 of the second protrusion 42 is inclined but also the corner of the leading end of the terminal piece 91 on the side of the second protrusion 42 is bent upward. Consequently, when turning the tubular main body 1 inserted in the loading hole 81 in order to load the socket device S on the printed circuit board 8, there is no fear of the deformation of terminal piece 91 by collision with the edge of the recess portion 82, 82 of the printed circuit board 8, it slides smoothly on the wire conductors around the loading hole 81 of the printed circuit board 8.

Also in the socket device S of the second embodiment of the present invention, when loading socket device in the loading hole 81 of the printed circuit board 8, there is no fear of deformation of the terminal piece 91, because the terminal piece 91 led out of the tubular main body 1 is extending to a position enclosed by protrusion 41, 42 or flange portion 2. Therefore, the loading operation can be performed easily and smoothly as well as a reliable electrical connection is secured.

The present invention is not limited to the above-mentioned embodiments, but various modifications are available as will be mentioned below.

Firstly, the baseless lamp to be loaded on the tubular main body 1 is not limited to the electric lamp, but LED (light emitting diode) lamp or small size electric discharge lamp may be used.

Secondly, rubber can be used for a material making the tubular main body 1 other than the thermoplastic resin such as 66 Nylon (brand name). The cross section of the tubular main body 1 is not limited to be cylindrical, but may be quadrangular or polygonal.

Thirdly, the flange portion 2 formed on the outer surface of the tubular main body 1 may partly include a deficit portion in its outer periphery.

Fourthly, the first and the second protrusion 41, 42 formed on the outer surface of the tubular main body 1, were provided 2 sets (1 pair) on the opposite position (180.degree.) in the diametrical direction. However, only one protrusion 41 or 42 maybe provided on the outer surface of the tubular main body 1 or three or more protrusions may be provided at a prescribed angle spacing on the cross sectional plane of the tubular main body 1. In this case, loading the socket device S for a polarity specified lamp such as LED lamp etc. with a wrong polarity can be prevented by varying the angle spacing instead of employing an equal spacing.

Fifthly, the first and the second protrusion 41, 42 may change their position to each other. In that case, the turning direction of the socket device S when loading on the printed circuit board 8 is reversed with respect to the first embodiment.

Sixthly, the connecting members 5*a* or 5*b* can be made of a metal plate having electric conductivity and elasticity such as brass or stainless steel. The shapes of the bent portion of the metal plate are not limited to those in the above-mentioned embodiment. Further, the terminal piece 53 or 91 led out of the notch 3 is provided on a side of the printed circuit board 8, where the first and the second protrusions 41, 42 are provided. However, another terminal piece may be provided at a position facing to the terminal piece 53 or 91 on the other side of the printed circuit board 8. In this case, it is preferable to put the terminal piece in a groove formed on the surface of the flange 2.

Figure 10:
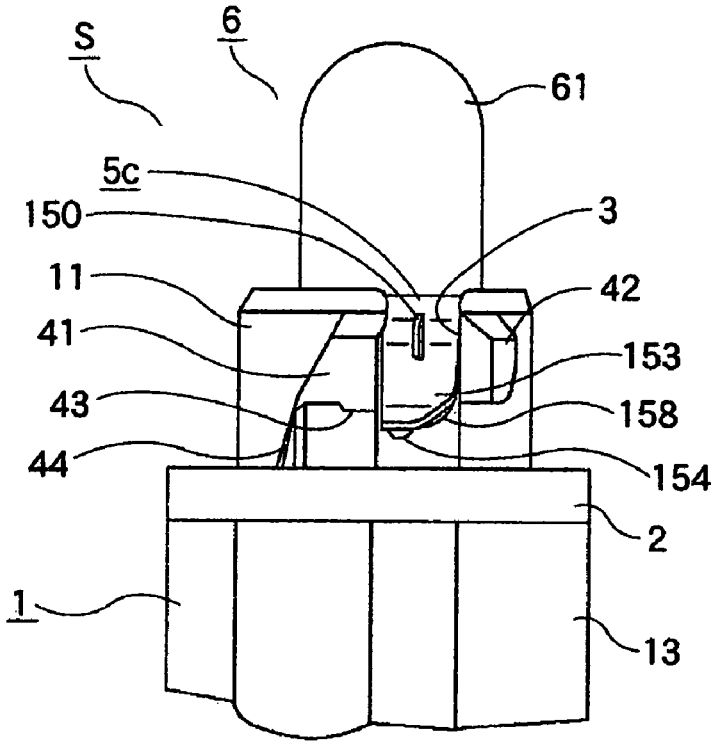
FIG. 10 is a front view showing another embodiment of the socket device according to the present invention.
Figure 11:
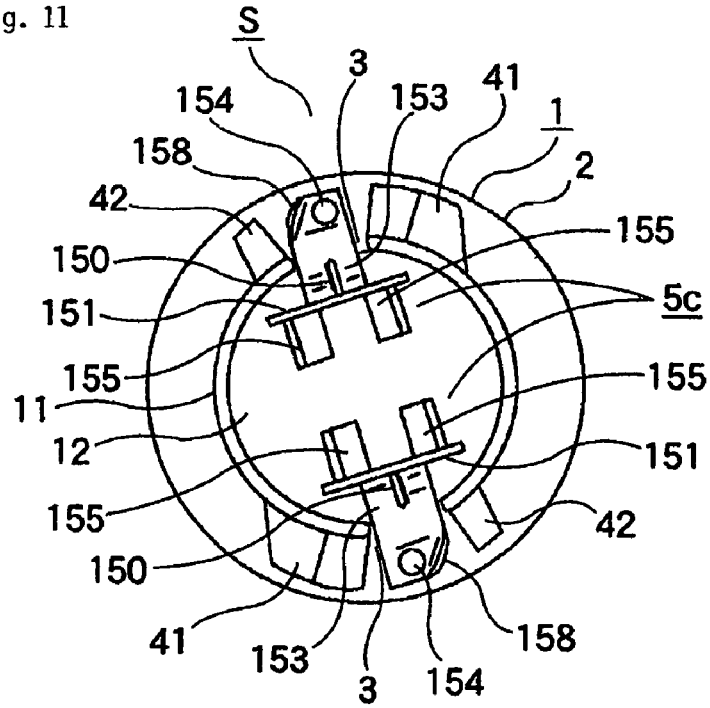
FIG. 11 is a top view showing the socket device shown in FIG. 10.

Another embodiment of the socket device according to the present invention will be explained referring to FIGS. 10 to 14. FIG. 10 is a front view of a socket device S and FIG. 11 is a top view of a tubular main body 1 when a lamp is not loaded. In the following description, words "upper" or "lower" are used in the figure as a matter of convenience and may be replaced in the figure when upside down.

In FIGS. 10 to 11, the same elements are assigned to parts as those in FIGS. 1 and 2. A detailed explanation of the similarly referenced elements is included herein above. A tubular main body flange portion 2 protrudes continuously around the outer surface of periphery wall 11 at vertically middle section of the main body 1.

A pair of connecting members 5*c*, 5*c* are a composed of a metal plate having high electric conductivity and elasticity such as brass and are contained standing face to face in the lamp loading hole 12 formed on the tubular main body 1.

Figure 12:
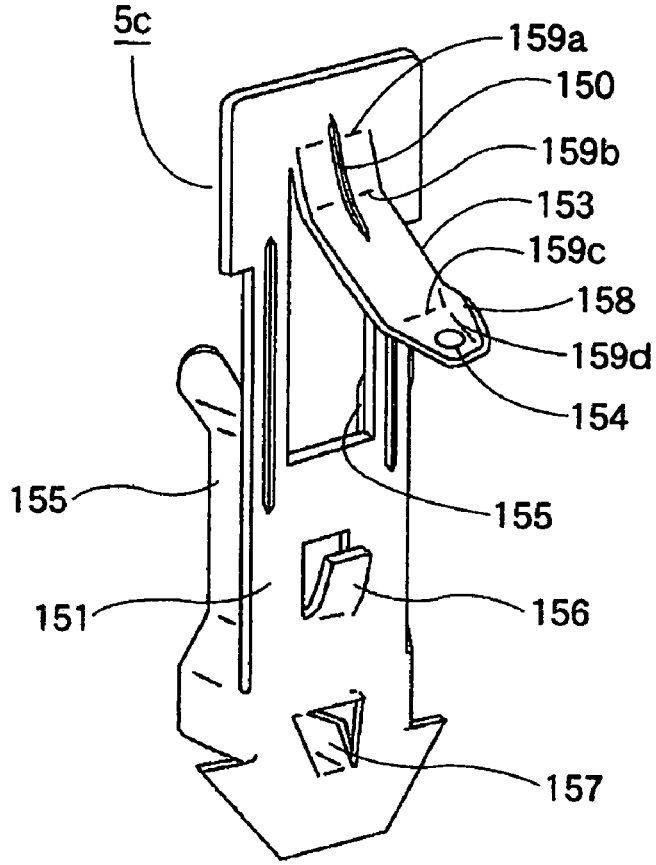
FIG. 12 is a perspective view showing a connecting member of the socket device shown in FIG. 10.

One of the connecting members 5*c*, 5*c* is shown in FIG. 12, in which a base portion 151 having nearly flat surface is engaged in latch groove (not illustrated) formed in the loading hole 12. The base portion 151 is cut in nearly square-built "U" shape at its upper portion to form an electricity conducting terminal piece 153. The terminal piece 153 is connected with the base portion 151 and is bent at the connected portion and its lower leading end is extended downward at an angle of less than 90° with the base portion 151. The leading end is then extended through the notch portion 3 of the tubular main body 1 to a vicinity of the flange portion 2.

Figure 13:
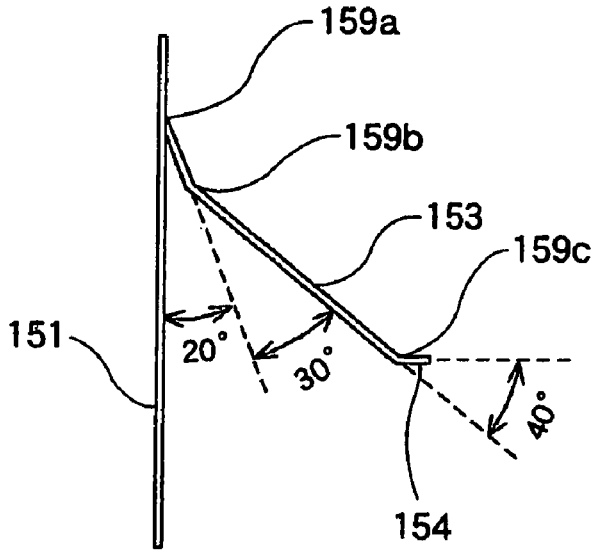
FIG. 13 is an illustrative diagram of a connecting member of the socket device shown in FIG. 10.

FIG. 13 is a schematic diagram of the conducting terminal piece 53. As shown in FIG. 13, the terminal piece 153 is bent at a first bending portion (cut and raised portion) 159*a* with an angle of about 20° to the base portion 51 having an angle 0° (vertical). Then, the terminal piece 153 is bent at second bending portion 159*b* with an angle of about 30° to the terminal piece 153 bent at the first bending portion. Similarly, the terminal piece 153 is bent at third bending portion 159*c* with an angle of about 40° to the terminal piece 153 bent at the second bending portion 159*b* and the leading end is thus nearly/substantially orthogonal to the base portion 151.

Figure 14:
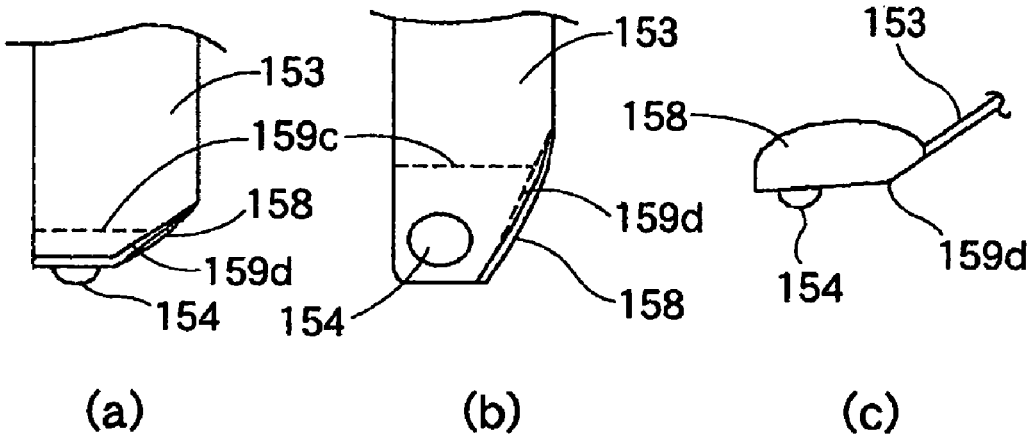
FIG. 14 is an illustrative example of an enlarged view of a vicinity of an end of an electricity conducting terminal piece in accordance with at least one aspect of the present invention.

FIG. 14 shows an enlarged view of the vicinity of the end of the electricity conducting terminal piece. FIG. 14(*a*) is a front view. FIG. 14(*b*) is a top view. FIG. 14(*c*) is a side view. As shown in FIG. 14, a twisted portion 159*d* is formed at the leading end of the terminal piece 153, in which a corner of the leading end is bent upward by an angle of about 50° to a plain of the top portion of the terminal piece 153. Thus, an inclined plane 158 is formed on the upward twisted portion 159*d*. Under the flat portion of the leading end of the terminal piece 153 next to the twisted portion 159*d*, a semi-sphere or convex shape contact portion 154 protruding downward is provided.

Here, the contact portion 154 is extended to a position lower than the convex portion 43 on the lower surface of the first protrusion 41 and the spacing between the contact portion 154 and the upper surface of the flange portion 2 is smaller than the thickness of the printed circuit board to be clipped.

As shown in FIG. 12, the connecting member 5*c* is provided with a rib 150 across the base portion 151 and the bend portion 159*a*, 159*b* of the terminal piece 153. A pair of pinching pieces 155, 155 is provided for latching flatly crushed opposing faces of a sealed portion 65 of baseless small size bulb 6 as shown in FIG. 5. The connecting member 5*c* is also provided with a protrusion 156 for engaging the connecting member 5*c* in the loading hole 12. The protrusion 156 is formed by cutting the base portion 151. The connecting member 5*c* is further provided with a lamp support protrusion 157 for supporting the base of the lamp.

A baseless small lamp 6 of wedge base type has a coil shaped filament enclosed inside a glass bulb 61 (shown in FIGS. 5 and 10). When the socket device S is inserted in the lamp-loading hole 12, both sides of the sealing portion 65 of the baseless small bulb 6 are inserted between the pinching pieces 155, 155 of connecting members 5*c*, 5*c* arranged in the lamp loading hole 12. More specifically, the lower sealing portion of bulb 61 is pinched and pressed between the pinching pieces 155, 155 of connecting members 5*c*, 5*c* and the protrusions (not shown but one of them is shown as 95 in FIG. 9(A)) for engaging with the concave portion formed on the sealing face (not shown) to make a strong holding. The pinching pieces 155, 155 contact with outer lead wires led out from sealing portions 65 on both sides to make an electrically favorable connection.

Figure 15:
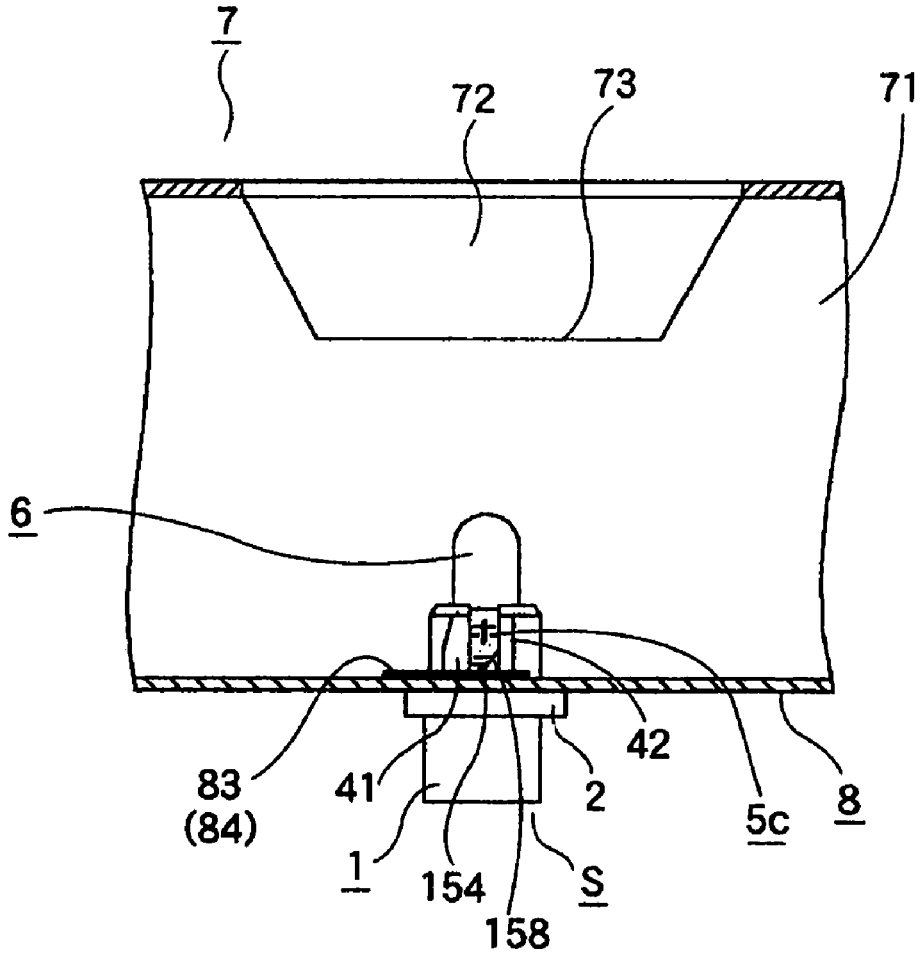
FIG. 15 is a side sectional view partly showing an example of display unit in which the socket device shown in FIG. 10 is used.
Figure 16:
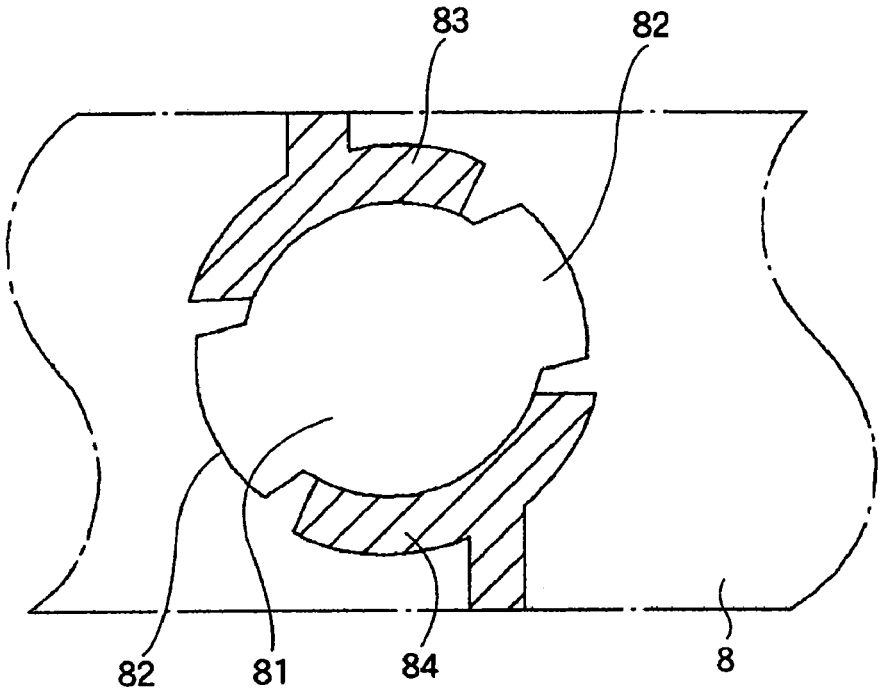
FIG. 16 shows the socket device shown in FIG. 10 loaded on a printed circuit board, wherein (a) is a plan view showing a part of the circuit board, (b) is a plan view showing a part of the printed circuit board in which the socket device is loaded.
Figure 16:
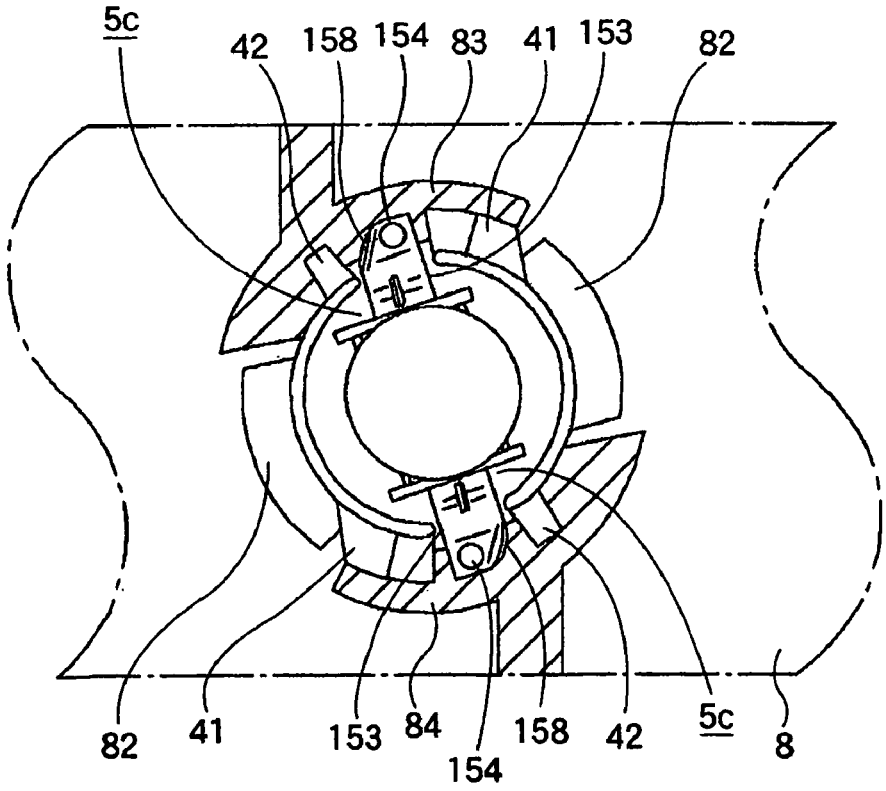

FIG. 15 is a side sectional view showing a part of display unit 7 assembled in a meter for cars, in which the socket device S is mounted. FIG. 16(*a*) is a plan view showing a part of a circuit board, on which the socket device S is to be loaded, which is used for explaining a method for mounting the socket device S on the circuit board.

In FIGS. 15 and 16, the same elements are assigned to parts as those in FIGS. 7–8. A detailed explanation of the similarly referenced elements is included herein above.

The spring force of electricity conducting terminal piece of the connecting member was degraded to decrease contact pressure in the conventional socket device, when loading and unloading of a socket device S is repeated many times or loading continued for a long time.

However, the connecting member 5*c*, 5*c* according to the present invention is reinforced because the terminal piece 153 is bent at a plurality of bend portions 159*a* to 159*c* and the rib 150 is provided on the terminal piece 153 and degradation of spring force the at the terminal piece 153 may be prevented.

Therefore, even though loading and unloading of the socket device S is repeated many times, or the loading state is continued for a long time, unwished deformation or degradation in the spring elasticity may be prevented and the electrical connection is secured by strongly pressing the contact portion 154 of the leading end of the terminal piece 153 to the interconnection conductor 83, 84 shown in FIG. 15.

Further, according to the socket device S described, the inclined plane 158 formed on the corner portion of the leading end of the terminal piece 153 guides the circuit board 8 smoothly into the smallest gap between the contact portion 154 and the upper surface of the flange portion 2, when the socket device S is loaded on the circuit board 8, without any fear to deforming of the terminal piece 153, in the similar manner to the embodiment shown in FIGS. 8 to 9.

The above embodiment is described in more detail below as an example. A terminal member 5*c* shown in FIG. 12 may be made using a phosphor bronze plate of about 0.2 mm thick, which is pressed to make the terminal piece 153. In this example, the terminal piece 153 has a maximum width of about 1.8 mm and length of about 4 mm. The bending angle at the first bend portion 159*a* is about 20°. The bending angle at the second bend 159*b* is about 30°. The bending angle of the third bend 159*c* is about 40°. The contact portion 154 on the leading end of the terminal piece 153 is formed in an oval spherical shape having a curvature of about 0.35 mm and axis of about 0.5 mm×about 0.7 mm. An inclined plane 158 connecting with the contact portion 154 is formed with the inclined angle of about 52° and the height of about 0.9 mm high. On the terminal piece 153, a rib 150 having a dimension of about 0.4 mm wide×about 2 mm long×about 0.5 mm high is formed across the first bend 159*a* and second bend 159*b*.

Figure 17:
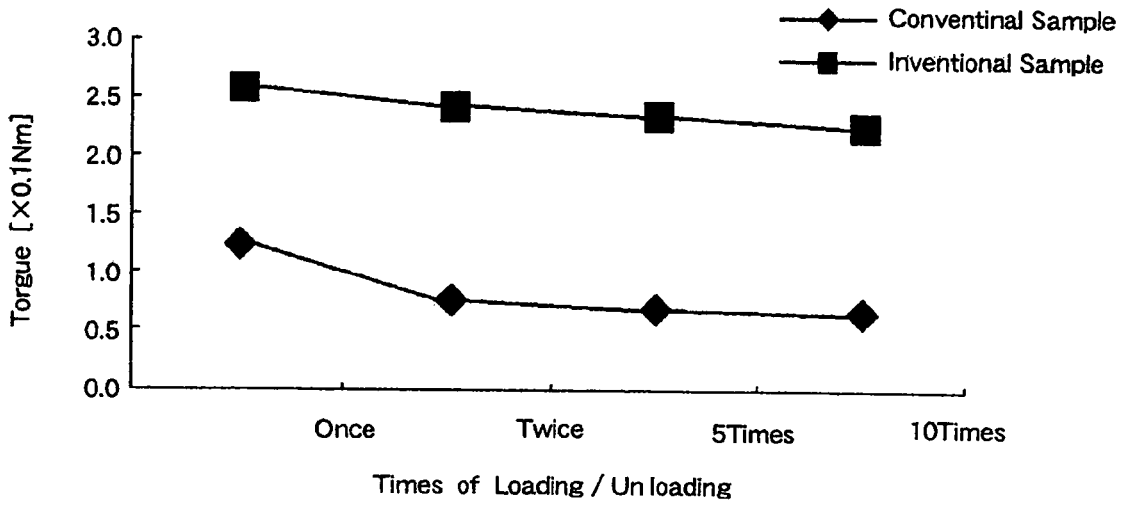
FIG. 17 is a graphical illustration showing a change in torque when repeating a loading and unloading of a socket device to a printed circuit board.

Two pieces of the terminal member 5*c* and a baseless bulb were stored inside the main body 1 to construct socket device S. The socket device S, in which a pair of the terminal member 5*c*, 5*c* and the baseless small lamp 6 were mounted, was examined with the spring characteristics when the socket device S was repeatedly loaded and unloaded in the socket loading hole 81 of the printed circuit board 8 and when a load was applied to the terminal piece 153. Results are shown in FIG. 16 and FIG. 17 respectively. Here, in the figure, the conventional sample means the one having the same material and dimensions of each part as those of the present invention, but the ribs 150 are not provided on the terminal pieces 153.

FIG. 17 is a graph showing change in torque when repeating the loading and the unloading of the socket device to a printed circuit board. The measured value is a return torque at the time of unloading, in which the abscissa indicates number of loading and unloading times, while the ordinate indicates torque (×0.1 Nm). The same socket device was used during measurement but a new printed circuit board was used at every loading and unloading time.

Figure 18:
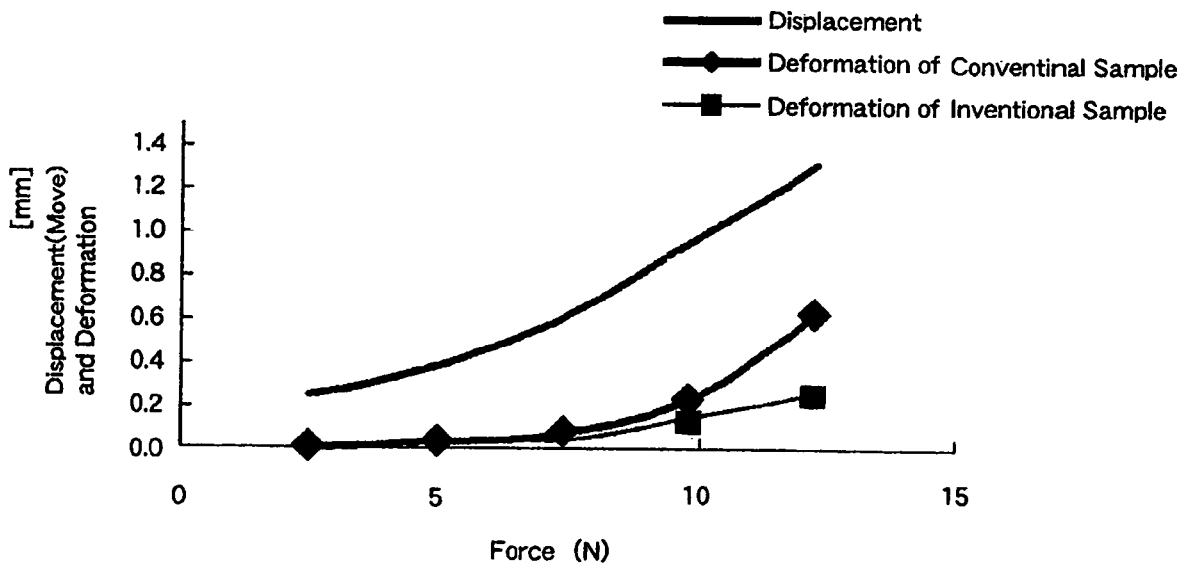
FIG. 18 is a graphical illustration of spring elasticity characteristics in accordance with at least one aspect of the present invention.

FIG. 18 shows spring elasticity characteristics obtained by measuring the displacement (move) of the contact portion 154 at the time when load is applied on the terminal piece 153, and the displacement of the contact portion 154 when the applied load is released, which is called deformation, comparing with the conventional socket. In FIG. 18, the abscissa indicates force (Nm) and the ordinate indicates displacement (move) value (mm) and deformation value (mm).

As it is clear from FIG. 17 and FIG. 18, the socket device S according to the embodiment of the present invention, in which the rib 150 is provided, provide a reliable electric connection with and a strong mechanical holding of the printed circuit board 8, because it has a high contact pressure at the contact portion 154 due to a high elastic characteristics compared with the conventional socket device.

While illustrative systems and methods as described herein embodying various aspects of the present invention are shown, it will be understood by those skilled in the art, that the invention is not limited to these embodiments. Modifications may be made by those skilled in the art, particularly in light of the foregoing teachings. For example, each of the elements of the aforementioned embodiments may be utilized alone or in combination or subcombination with elements of the other embodiments. It will also be appreciated and understood that modifications may be made without departing from the true spirit and scope of the present invention. The description is thus to be regarded as illustrative instead of restrictive on the present invention.

We claim:

1. A socket device comprising:

a tubular main body which is composed of electrically insulating material forming a lamp-loading hole having an opening at an upper end from which a baseless lamp is inserted;

a notch formed in a wall of the tubular main body extending downward from the opening of the lamp-loading hole along its axis;

a flange portion formed at a lower end portion of the notch on an outer surface of the wall of the tubular main body extending along its circumferential direction;

a first and a second protrusions which are provided on both sides of the notch on the outer surface of the wall with a prescribed spacing from the flange portion; and an electrically conducting connecting member having:

a base portion, which is loaded in the lamp-loading hole, a terminal piece, which extends through the notch to a position between the first and the second protrusions, and a lamp support protrusion, which supports the base of the baseless lamp, wherein the tubular main body of the socket device is inserted in a loading hole formed on the printed circuit board and is turned with the printed circuit board sandwiched between the flange portion and the first and the second protrusions, thereby being loaded on the printed circuit board, wherein the first protrusion has a stopper portion, which is extended to the flange portion or its vicinity, so as to stop further turning of the socket device on the printed circuit board, when the socket device is loaded on the loading hole of the printed circuit board.

2. A socket device according to claim 1, wherein a leading end of the terminal piece is placed at a position spaced from the flange portion.

3. A socket device according to claim 2, wherein the terminal piece is in contact with a wire connector formed on a surface of a printed circuit board.

4. A socket device according to claim 1, wherein the second protrusion has an under surface, which faces the flange portion and is so inclined as to make the insertion of the printed circuit board into a space between the under surface of the second protrusion and the flange portion easy, when the socket device is loaded in the loading hole of the printed circuit board.

5. A socket device according to claim 4, wherein a corner portion of the leading end of the terminal piece is bent upward in order to make the insertion of the printed circuit board easy, when the socket device is loaded in the loading hole of the printed circuit board.

6. A socket device according to claim 5, wherein the connecting member supports a sealing portion of the baseless lamp at the base portion loaded in the lamp-loading hole, and contacts with a pair of outer leads of the baseless lamp, which are exposed on both sides of the base portion for electrical connection.

7. A socket device according to claim 6, wherein a pair of pinching pieces is formed on the base portion, the pinching pieces being arranged in parallel and facing each other.

8. A socket device according to claim 7, wherein a convex contacting protrusion is formed at least on one of the pair of pinching pieces, and a coupling convex is formed on the base portion.

9. A socket device according to claim 8, wherein a grip portion for holding the tubular main body is provided at a portion below the flange portion of the tubular main body.

10. A socket device according to claim 1, further comprising:

a second notch formed in the wall of the tubular main body;

a third and fourth protrusions which are provided on both sides of the second notch on the outer surface of the wall; and a second electrically conducting connecting member having:

a base portion, which is loaded in the lamp-loading hole, and a terminal piece, which extends through the second notch to a position between the third and the fourth protrusions.

11. A socket device according to claim 10, wherein the two notches are formed on the outer surface of the wall on diametrically opposite positions of the opening of the tubular main body.

12. A socket device according to claim 11, wherein the two connecting members are loaded in the lamp-loading hole to support the sealing portion of the baseless lamp at each base portion, and wherein the two connecting members contact with the outer lead of the baseless lamp exposed on both sides of the base portion to be electrically connected.

13. A socket device according to claim 1, further comprising a third protrusion, which engages the connecting member in the lamp-loading hole.

14. A socket device according to claim 1, wherein the terminal piece is bent at a first bending portion, a second bending portion, and a third bending portion.

15. A socket device according to claim 14, wherein the first bending portion is at an angle of approximately 20 degrees relative to the base portion, the second bending portion is at an angle of approximately 30 degrees relative to the first bending portion, and the third bending portion is at an angle of approximately 40 degrees relative to the second bending portion.

16. A socket device according to claim 14, wherein the leading end of the terminal piece is substantially orthogonal to the base portion.

17. A lighting device comprising:

a base body;

a printed circuit board provided on the base body; and a socket device including:

a tubular main body which is composed of electrically insulating material forming a lamp-loading hole having an opening at an upper end from which a baseless lamp is inserted;

a notch formed in a wall of the tubular main body extending downward from the opening of the lamp-loading hole along its axis;

a flange portion formed at a lower end portion of the notch on an outer surface of the wall of the tubular main body extending along its circumferential direction;

a first and a second protrusions which are provided on both sides of the notch on the outer surface of the wall with a prescribed spacing from the flange portion; and an electrically conducting connecting member having:

a base portion, which is loaded in the lamp-loading hole, a terminal piece, which extends through the notch to a position between the first and the second protrusions, and a lamp support protrusion, which supports the base of the baseless lamp, wherein the tubular main body of the socket device is inserted and loaded in a loading hole formed on the printed circuit board and is turned with the printed circuit board sandwiched between the flange portion and the first and the second protrusions, thereby being loaded on the printed circuit board, wherein the first protrusion has a stopper portion, which is extended to the flange portion or its vicinity, so as to stop further turning of the socket device on the printed circuit board, when the socket device is loaded on the loading hole of the printed circuit board.

18. An electrically conducting connecting apparatus comprising:

a base portion configured to be loaded into a lamp-loading hole;

a terminal piece configured to extend through a notch formed in a wall of a tubular main body to a position between a first and a second protrusion, the terminal piece including a rib;

a lamp support protrusion configured to support the base of a baseless lamp; and a third protrusion configured to engage the connecting apparatus in the lamp-loading hole, wherein the terminal piece is bent at a first bending portion, a second bending portion, and a third bending portion, wherein an end of the terminal piece is substantially orthogonal to the base portion, wherein the first bending portion is at an angle of approximately 20 degrees relative to the base portion, the second bending portion is at an angle of approximately 30 degrees relative to the first bending portion, and the third bending portion is at an angle of approximately 40 degrees relative to the second bending portion.

* * * * *